United States Patent [19]

Barnes

[11] 4,303,384

[45] Dec. 1, 1981

[54] FLAME FAILURE DEVICE

[75] Inventor: Hugh V. Barnes, London, England

[73] Assignee: T.I. Domestic Appliances, Ltd., London, England

[21] Appl. No.: 47,179

[22] Filed: Jun. 8, 1979

[30] Foreign Application Priority Data

Apr. 25, 1979 [GB] United Kingdom ..... 14371/79

[51] Int. Cl.[3] ..... F23Q 9/08

[52] U.S. Cl. ..... 431/58; 431/83; 137/65

[58] Field of Search ..... 431/58, 83, 84; 137/65, 137/489

[56] References Cited

U.S. PATENT DOCUMENTS

| | | | |
|---|---|---|---|
| 1,038,096 | 9/1912 | Debley | 431/84 |
| 1,467,049 | 9/1923 | Long | 431/58 X |
| 2,179,633 | 11/1939 | Jenkins | 431/84 X |
| 2,319,676 | 5/1943 | Guelson | 431/58 X |
| 2,427,935 | 9/1947 | Van Denberg et al. | 137/65 |
| 2,499,073 | 2/1950 | Newell | 431/84 X |
| 3,314,604 | 4/1967 | Branson | 431/58 X |
| 3,490,854 | 1/1970 | Pipes | 431/82 |
| 3,528,758 | 9/1970 | Perkins | 431/67 |
| 3,559,884 | 2/1971 | Visos et al. | 236/80 |

FOREIGN PATENT DOCUMENTS

| | | | |
|---|---|---|---|
| 2506697 | 4/1976 | Fed. Rep. of Germany | 431/83 |
| 1147630 | 11/1957 | France | 431/58 |
| 296973 | 4/1929 | United Kingdom . | |
| 635542 | 4/1950 | United Kingdom . | |
| 703797 | 2/1954 | United Kingdom . | |
| 826406 | 1/1960 | United Kingdom . | |
| 837789 | 6/1960 | United Kingdom . | |
| 878359 | 9/1961 | United Kingdom . | |
| 892093 | 3/1962 | United Kingdom | 431/58 |
| 1037209 | 7/1966 | United Kingdom . | |
| 1045131 | 10/1966 | United Kingdom . | |
| 1100061 | 1/1968 | United Kingdom . | |
| 1405410 | 9/1975 | United Kingdom . | |

*Primary Examiner*—Samuel Scott

*Assistant Examiner*—Randall L. Green

*Attorney, Agent, or Firm*—Steele, Gould & Fried

[57] ABSTRACT

A flame failure device has a hollow, tubular, heat-resistant, temperature sensitive member to be directly heated by a flame and so arranged that the member will expand or contract along a generally rectilinear axis as it is heated or cooled. The temperature-sensitive member is connected to a mount in a manner which permits or permitted at least initial adjustment of the relative position of the mount and temperature-sensitive element along the generally rectilinear axis and has an abutment which will move relative to the mount as the temperature-sensitive member is heated or cooled. A main valve for controlling supply of fuel to a burner has a fuel inlet, a fuel outlet, a chamber having a diaphragm defining a wall of the chamber, a main-valve member operatively connected to the diaphragm and movable therewith, and a supply passage for restricted fuel flow to the chamber.

A pilot valve is connected to the chamber of the main valve having means for venting gas flowing therethrough from the chamber, for controlling opening and closing of the main valve and has a first valve member fixed relative to the mount and spaced from the abutment by a distance which can be or has been adjusted by means of the connection between the temperature-sensitive member and the mount and which varies as the temperature-sensitive member is heated or cooled, and a second valve member movable relative to the fixed valve member and operated by elongate means arranged in the temperature sensitive member. The elongate means and movable valve member are arranged to move under the influence of resilient means so as to close the pilot valve when the temperature-sensitive member is heated and by engagement between the abutment and elongate means to open the pilot valve on cooling of the temperature-sensitive member. The main valve is arranged to open when the pilot valve is closed and to close when the pilot valve is open.

18 Claims, 7 Drawing Figures

FIG. 5.
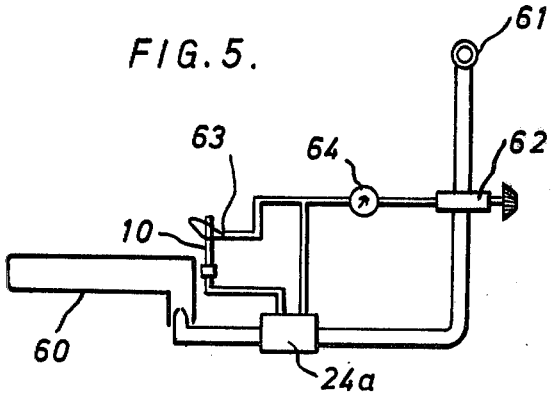
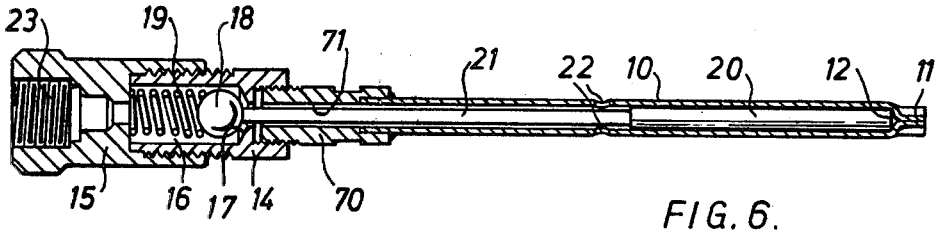
FIG. 6.
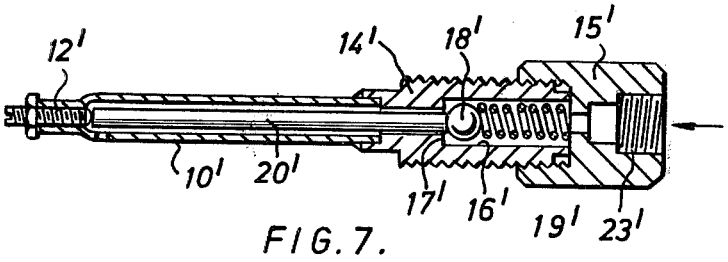
FIG. 7.

FLAME FAILURE DEVICE

BACKGROUND AND SUMMARY OF THE INVENTION

This invention relates to a flame failure device.

The invention provides a flame-failure device comprising:

a heat-resistant, temperature sensitive member to be directly heated by a flame and so arranged that the member will expand or contract along a generally rectilinear axis as it is heated or cooled;

a mount to which one portion of the temperature-sensitive member is connected and relative to which another portion of the temperature-sensitive member will move as the temperature-sensitive member is heated or cooled;

a main valve for controlling supply of fuel to a burner and having a fuel inlet, a fuel outlet, a chamber having a diaphragm defining a wall of the chamber, a main-valve member operatively connected to the diaphragm and movable therewith, and passage means whereby a restricted fuel flow can be supplied to the chamber, and a pilot valve connected to the chamber of the main valve, having means for venting fuel flowing therethrough from the chamber, for controlling opening and closing of the main valve and having a fixed valve member fixed relative to the mount and a movable valve member movable relative to the fixed valve member and operated by elongate means arranged alongside the temperature sensitive member, the elongate means and movable valve member being arranged to move so as to close the pilot valve when the temperature-sensitive member is heated and to open the pilot valve on cooling of the temperature-sensitive member, the main valve being arranged to open when the pilot valve is closed and to close when the pilot valve is open.

Preferably, the temperature-sensitive device is hollow, tubular configuration and the elongate means is arranged therein.

The elongate means may consist of a single elongate member of non-temperature sensitive material, although, advantageously, comprises a first elongate member of non-temperature sensitive material and a second elongate member between the first elongate member and the movable valve member. Desirably, in this case the second elongate member is of temperature-sensitive material.

Preferably, the temperature-sensitive member has a vent to allow gas entering the pilot valve from the chamber to escape. In a case where the elongate means comprises said first and second elongate members, advantageously the first elongate member is a close sliding fit in the temperature-sensitive member and the vent is nearer than the first elongate member to the fixed valve member.

Preferably, the temperature-sensitive member has an abutment which moves the elongate means on cooling of the temperature-sensitive member. Advantageously, the position of the abutment relative to the fixed valve member is or was at least initially adjustable along said generally rectilinear axis.

Conveniently, said one portion of the temperature-sensitive member is connected to the mount by connecting means which permits or permitted at least initial adjustment of the relative positions of the mount and temperature-sensitive member along said generally rectilinear axis. The connecting means may comprise complementary screw-threads on said one portion of the temperature-sensitive member and the mount. In this case, the abutment may be provided by a deformed zone of said another portion, such as a crimped end, of the temperature-sensitive member.

Alternatively, the abutment is an adjustable screw-threaded member.

The invention also provides an appliance having a main burner and a flame failure device as above described, to provide a flame failure device controlling fuel flow to the main burner.

BRIEF DESCRIPTION OF THE DRAWINGS

The invention will now be more particularly described with reference to the accompanying drawings, wherein:

FIG. 5 is a schematic diagram of an alternative burner system incorporating the flame failure device of FIGS. 1–3 with a slight modification, FIG. 6 is a sectional view showing a modified connection between the temperature-sensitive member and the mount of FIG. 1, and FIG. 7 is a sectional view through part of a further embodiment of a flame failure device according to the invention.

DETAILED DESCRIPTION OF THE PREFERRED EMBODIMENTS

Figure 1:
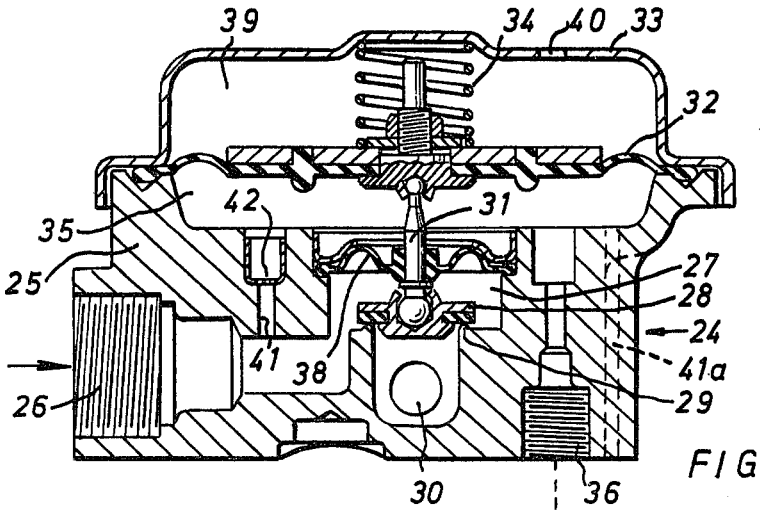
FIG. 1 is a horizontal sectional view through one embodiment of a flame failure device according to the invention.
Figure 3:
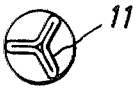
FIG. 3 is a view along line III—III of FIG. 1.

Referring now to FIG. 1, the flame failure device shown therein comprises a heat resistant, temperature-sensitive member in the form of a hollow tube 10 which is closed at one end 11 by three-point crimping (as shown in FIG. 3) to define an abutment 12 and which is externally screw-threaded at its other end 13 for screw-threaded engagement with a complementary internal screw thread on a mount which forms a first valve part 14 of a pilot valve. The valve part 14 is externally threaded and fits inside a correspondingly threaded support part 15 of the pilot valve.

Figure 2:
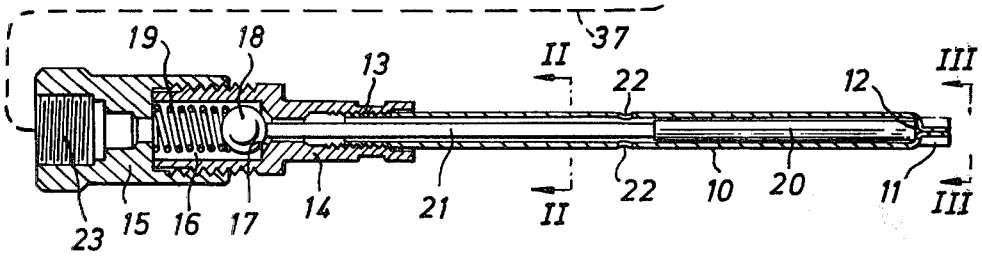
FIG. 2 is a sectional view along line II—II of FIG. 1.
Figure 2:
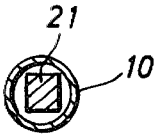

As can be seen from the drawing, the valve part 14 has an internal bore 16 which is stepped to provide a fixed valve in the form of a seat member 17. The wider part of the bore 16 contains a movable valve member in the form of a ball 18 and resilient means in the form of compression spring 19 which urges the ball towards the seat 17. When the ball 18 contacts the seat 17 it closes the wider part from the narrower part of the bore 16. The tube 10 contains elongate means comprising a first elongate member in the form of a rod 20 of non-heat sensitive material, e.g. of fused silica, and a second elongate member in the form of a rod 21 of heat-sensitive material. The rod 20 is arranged to be a close sliding fit within the tube 10 and is engageable by the abutment 12 for a purpose which will become apparent hereinafter. The rod 21 is interposed between the ball 18 and the rod 20 and is of non-matching cross section with the tube 10 and as shown is of square cross-section (see FIG. 2) whereas the tube is of right cylindrical cross section. The tube 10 has two vents 22 which are nearer than the rod 20 to the seat 17, and the passages defined between the rod 21 and the inner surface of the tube 10 provide communication between the bore 16 of the pilot valve, when the ball is disengaged from the seat 17, and the vents 22.

The support part 15 has a bore 23 aligned with the bore 16 and is internally threaded to receive a connection to a main valve 24.

The main valve 24 has a body 25 with a gas inlet passage 26 for conveying gas to a chamber 27 at the bottom of which is a valve 28 which can seat against a valve seat 29 to control the passage of gas to an outlet passage 30 in the body 25. The valve 28 is connected by means of a stem 31 extending through the chamber 27 to a diaphragm 32 secured to the body 25 by a top cover 33 and is urged towards the seat by means of a compression spring 34. The diaphragm 32, valve body 25 and top cover 33 define a lower chamber 35 separated from chamber 27 by a diaphragm seal 38 and connected to the pilot valve by a bleed pipe connection 36 and a bleed pipe indicated by the broken line 37, and an upper chamber 39 connected to atmosphere by a vent-hole 40. A passage 41 having a restrictor 42 therein permits a very small flow of gas from the inlet 26 to the lower chamber 35.

The device operates as follows. In the cold condition (no flame) gas enters the main valve 24 and fills the chamber 27; gas also flows through the passage 41 with restrictor 42 into the chamber 35 and then through the pilot valve to the vents 22 from where it escapes. This flow of gas is insufficient to produce any substantial increase of pressure in chamber 35, and consequently the valve 28 remains closed.

When the tube 10 is heated by a flame (not shown) in a region between the vents 22 and its end 11, it expands rapidly thus moving the abutment 12 in a direction away from the seat 17 and as the rod 20 does not expand or expands by only a relatively small amount, the rod 21 is pushed beyond the seat 17 into the narrower part of the bore 16 by means of the spring 19 via the ball 18 until the ball contacts the seat 17. The pilot valve is closed and gas cannot escape from the chamber 35 of the main valve 24. The pressure in this chamber 35 therefore increases and exerts a force on the diaphragm 32 sufficient to open the valve 28 against the action of the spring 34. Gas is thus allowed to pass from the inlet 26 to the outlet 30 of the main valve 24.

If the flame is extinguished for any reason the tube 10 contracts until the abutment 12 abuts the rod 20 so as to move the rod 21 along the narrower part of the bore 16, past the seat 17 and into the wider part of the bore 16 thus forcing the ball 18 away from the seat 17 against the action of the spring 19. Gas entering the chamber 35 of the main valve 24 from the inlet 26 can now flow through the bleed pipe connection 36, the bleed pipe 37, bore 16, tube 10 and vents 22. The resulting drop of pressure in the chamber 35 allows the spring 34 to move the diaphragm to close the main valve 24. The main valve cannot be reopened until the flame is re-lit.

The adjustable screw-threaded connection between the tube 10 and valve part 14 allows the distance between the abutment 12 and the valve seat 17 to be adjusted so that in cold condition, i.e. there is no flame present, the pilot valve is open. This connection is well removed from the direct heat of a flame. After initial adjustment the tube 10 and valve part 14 are secured against relative rotation, such as by soldering. The abutment 12 is easily formed by crimping the end 11 of the tube 10 and it will be appreciated that the end 11 need not be sealed. The three-point crimping provides an abutment on the tube 10 by deforming the end thereof in such a manner that the external diameter of the tube 10 is not increased at the end 11.

The provision of the rod 21 keeps the length of the more readily breakable rod 20 to a minimum, thus reducing the risk of breakage thereof while maintaining the valve part 14 at a position remote from a flame to avoid damage to the valve part 14. The risk of breakage of the rod 20 is further reduced by maximising its diameter to the extent permitted by the dimension of the tube 10.

Figure 4:
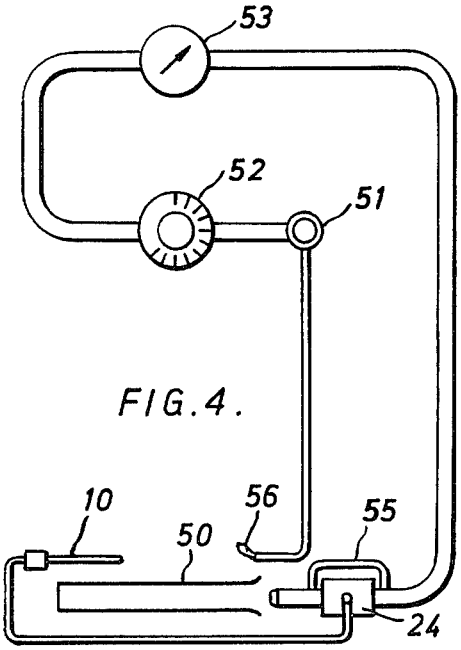
FIG. 4 is a schematic diagram of a burner system incorporating the flame failure device of FIGS. 1–3.

An example of a burner installation incorporating the above-described flame failure device is shown in FIG. 4. Gas is supplied to an oven burner 50 from the supply 51 via combined tap and thermostat 52, clock controlled valve 53 and flame failure valve 24. A controlled bypass passage 55, round valve 24 supplies gas to the burner for ignition purposes. The heat sensitive tube 10 of the flame failure pilot valve is placed at the end of the oven burner opposite to the ignition 55. The ignition may be by spark or by permanent pilot.

The sequence of operations is as follows:

The tap and thermostat 52 is turned to the required cooking setting and gas flows to the clock valve 53 where it is stopped. The clock is set to open the valve 53 at the required time. When this time is reached, the valve 53 opens and allows gas to pass to the flame failure valve 24 and bypass 55. The small quantity of gas allowed through the bypass 55 passes to burner 50 where it is ignited by pilot 56.

The flame travels along the burner to the end where the heat sensitive tube 10 is situated and heats the tube 10, and the valve 24 operates as previously described.

Any gas or ignition failure only results in the allowable escape of gas to the oven burner via the bypass 55 and the vents 22, and prevents the full flow of gas to the burner 50.

Another example of a burner installation incorporating the above described flame failure device with a slight modification thereto is shown in FIG. 5. Gas is supplied to a main oven burner 60 from the supply 61 via a combined tap and thermostat 62 and flame failure main valve **24*a* and to a subsidiary burner 63 via the combined tap and thermostat 62 and a clock controlled valve 64. The temperature sensitive tube 10 of the flame failure pilot valve is placed adjacent to the burner 63. The main valve 24*a* is a modified version of the valve 24 and instead of passage 41 with restrictor 42 a passage 41*a* (shown in FIG. 1 by broken lines) connects the chamber 35 to the exterior of the valve body 25 and has a restrictor (not shown) therein. The outer end of the passage 41*a* receives gas supply from the downstream side of the valve 64 (see FIG. 5**).

The sequence of operation is as follows:

The tap and thermostat 62 is turned to the required cooking setting and gas flows to the clock valve 64 where it is stopped and to the main valve **24*a* where it is also stopped. The clock is set to open the valve 64 at the required time. When this time is reached, the valve 64 opens and allows a small quantity of gas to pass to the chamber 35 of the valve 24*a* and to the subsidiary burner 63 where it is ignited by a spark ignition device (not shown) which is caused to operate during the initial opening period of both combined tap and thermostat 62 and valve 64. The flame from burner 63 heats up the tube 10, and the pilot valve closes. Gas supplied to the chamber 35 via the combined tap and thermostat 62, valve 64 and passage 41***a* operates the valve 24*a* as previously described and gas is supplied via valve 24*a* to the burner 60 where it is ignited by the burner 63.

Any gas or ignition failure only results in the allowable escape of gas to the oven via subsidiary burner 63 and vents 22, and prevents the flow of gas to the burner 60.

Referring to FIG. 6, there is shown therein a modified connection between the heat sensitive member (tube 10) and the mount (valve part 14), wherein a coupler 70 having a stepped bore 71 is interposed between the tube 10 and valve part 14. The end of the tube 10 remote from the abutment is not externally threaded, but is located in the larger diameter end of the bore 71 and is secured to the coupler, such as by soldering or welding. The end of the coupler 70 remote from the tube is external screw-threaded for screw-threaded engagement with a complementary internal screw thread on the valve part 14 to permit the distance between the abutment 12 and the valve seat 17 to be adjusted initially as aforesaid. After initial adjustment the part 14 and coupler 70 may be and, preferably, are secured against relative rotation, such as by soldering.

Referring to FIG. 7, there is shown therein another embodiment of the pilot valve, in which a tube 10' is mounted, e.g. by welding, on the end of valve part 14' of the pilot valve. The valve part 14' is externally screw-threaded and fits inside a correspondingly screw-threaded support part 15'.

As in the above embodiment, the valve part 14' has an internal bore 16' which is stepped to provide a fixed valve member in the form of a seat 17'. The wider part of the bore 16' contains a movable valve member in the form of a ball 18' and a compression spring 19' which urges the ball towards the seat 17'.

The tube 10' contains a single elongate member in the form of a rod 20' of non temperature sensitive material, e.g. of fused silica, and has an adjustable abutment at the end remote from the valve part 14'. The abutment is in the form of a screw 12' which mates with an internal screw-thread in the end of the tube and has a lock nut. The tube also has a vent 12.

The support has a bore 23' aligned with the bore 16' and is internally threaded to receive a connection to the main valve in a manner identical to that described above.

The elongate member may be of non-matching, e.g. square, cross-section with the tube 10' but be so dimensioned as to be supported laterally by the tube to reduce the risk of breakage during movement of the pilot valve, such as during transportation.

I claim:

1. A flame-failure device comprising:

a heat-resistant, temperature-sensitive member to be directly heated by a flame and so constructed and arranged that the member will expand or contract along a generally rectilinear axis as it is heated or cooled;

a mount to which one portion of the temperature-sensitive member is connected and relative to which another portion of the temperature-sensitive member will move as the temperature-sensitive member is heated or cooled;

a main valve for controlling supply of fuel from a fuel supply means to a burner and having a fuel inlet, a fuel outlet, a chamber having a diaphragm defining a wall of the chamber, a main valve member located between the fuel inlet and fuel outlet and operatively connected to the diaphragm and movable therewith, and passage means communicating between the chamber and the fuel inlet whereby a restricted fuel flow can be supplied to the chamber; and, a pilot valve connected to the chamber of the main valve, having means for venting fuel flowing therethrough from the chamber, for controlling opening and closing of the main valve and having a first valve member fixed relative to the mount and a second valve member movable relative to the fixed valve member and operated by an elongate means arranged adjacent the temperature-sensitive member, the elongate means and movable valve member being arranged to move so as to close the pilot valve when the temperature-sensitive member is heated and to open the pilot valve on cooling of the temperature-sensitive member, the main valve being arranged to open when the pilot valve is closed and to close when the pilot valve is open.

2. A flame failure device as claimed in claim 1, wherein the movable member is a ball.

3. A flame failure device as claimed in claim 1, including resilient means urging the movable valve member towards the fixed valve member.

4. A flame failure device as claimed in claim 1, wherein the temperature-sensitive device is of hollow, tubular configuration and the elongate means is arranged therein.

5. A flame failure device as claimed in claim 4, wherein the elongate means consists essentially of a single elongate member of non-temperature sensitive material.

6. A flame failure device as claimed in claim 4, wherein the elongate means comprises a first elongate member of non-temperature sensitive material and a second elongate member between the first elongate member and the movable valve member.

7. A flame failure device as claimed in claim 6, wherein the second elongate member is of temperature-sensitive material.

8. A flame failure device as claimed in claim 5 or 6, wherein the non-temperature sensitive elongate member is of fused silica.

9. A flame-failure device as claimed in claim 4, wherein the means for venting fuel is a vent in the temperature-sensitive member.

10. A flame failure device as claimed in claim 9, wherein the elongate means comprises a first elongate member, which is of non-temperature sensitive material and which is a close sliding fit in the temperature-sensitive member and a second elongate member between the first elongate member and the movable valve member, the vent being nearer than the first elongate member to the fixed valve member.

11. A flame failure device as claimed in claim 4, wherein the temperature sensitive member has an abutment which moves the elongate means on cooling of the temperature-sensitive member.

12. A flame failure device as claimed in claim 11, wherein the position of the abutment relative to the fixed valve member is at least initially adjustable along said generally rectilinear axis.

13. A flame failure device as claimed in claim 12, wherein the abutment is an adjustable screw-threaded member.

14. A flame failure device as claimed in claim 12, wherein said one portion of the temperature sensitive member is connected to the mount by connecting means which permits at least initial adjustment of the relative positions of the mount and temperature-sensitive member along the said generally rectilinear axis.

15. A flame sensitive device as claimed in claim 14, wherein said connecting means comprises complementary screw-threads on said one portion of the temperature-sensitive member and the mount.

16. A flame sensitive device as claimed in claim 11, wherein a deformed zone of said another portion of the temperature-sensitive member provides said abutment.

17. A flame failure device as claimed in claim 16, wherein the deformed zone is a crimped end of the temperature-sensitive member.

18. A fuel burning appliance, having a flame-failure device, comprising:

a heat-resistant, temperature-sensitive member to be directly heated by a flame and so constructed and arranged that the member will expand or contract along a generally rectilinear axis as it is heated or cooled;

a mount to which one portion of the temperature-sensitive member is connected and relative to which another portion of the temperature-sensitive member will move as the temperature-sensitive member is heated or cooled;

a main burner;

a main valve for controlling supply of fuel from a fuel supply means and having a fuel inlet, a fuel outlet connected to the main burner, a chamber having a diaphragm defining a wall of the chamber, a main valve member located between the fuel inlet and fuel outlet and operatively connected to the diaphragm and movable therewith, and passage means communicating between the chamber and the fuel inlet whereby a restricted fuel flow can be supplied to the chamber; and, a pilot valve connected to the chamber of the main valve, having means for venting fuel flowing to therethrough from the chamber, for controlling opening and closing of the main valve and having a first valve member fixed relative to the mount and a second valve member movable relative to the fixed valve member and operated by an elongate means arranged adjacent the temperature-sensitive member, the elongate means and movable valve member being arranged to move so as to close the pilot valve when the temperature-sensitive member is heated and to open the pilot valve on cooling of the temperature-sensitive member, the main valve being arranged to open when the pilot valve is closed and to close when the pilot valve is open.

* * * * *